US006551144B2

(12) United States Patent
Wellmann et al.

(10) Patent No.: US 6,551,144 B2
(45) Date of Patent: Apr. 22, 2003

(54) ELECTRICAL CONNECTOR FOR CONNECTING ELECTRICAL WIRES TO AN ELECTRICAL APPARATUS

(75) Inventors: Christa Wellmann, Rahden (DE); Stephan Schreier, Rahden (DE); Dirk-Peter Post, Lübbecke (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/821,197

(22) Filed: Mar. 29, 2001

(65) Prior Publication Data

US 2001/0027051 A1 Oct. 4, 2001

(30) Foreign Application Priority Data

Mar. 30, 2000 (DE) ..... 200 05 868
Mar. 30, 2000 (DE) ..... 200 05 870

(51) Int. Cl.[7] ..... H01R 13/502

(52) U.S. Cl. ..... 439/689; 439/731; 439/76.1; 439/404; 439/903

(58) Field of Search ..... 439/404, 731, 439/687, 696, 903, 135, 521, 528, 689, 693, 695, 718, 892, 76.1, 620, 701

(56) References Cited

U.S. PATENT DOCUMENTS

| | | | | | |
|---|---|---|---|---|---|
| 4,629,269 | A | | 12/1986 | Kailus | |
| 4,737,124 | A | * | 4/1988 | Ezure et al. | 439/903 |
| 5,046,961 | A | * | 9/1991 | Hoffman | 439/141 |
| 5,609,499 | A | * | 3/1997 | Tan et al. | 439/731 |
| 5,626,486 | A | | 5/1997 | Shelly et al. | |
| 5,662,492 | A | * | 9/1997 | Weiss | 439/404 |
| 5,871,376 | A | | 2/1999 | Tsai et al. | |
| 5,954,541 | A | * | 9/1999 | Ozai et al. | 439/404 |
| 6,116,952 | A | * | 9/2000 | Nakata | 439/404 |
| 6,168,478 | B1 | * | 1/2001 | Daoud | 439/404 |
| 6,250,963 | B1 | * | 6/2001 | Wright | 439/903 |

FOREIGN PATENT DOCUMENTS

| | | |
|---|---|---|
| DE | 30 42 293 C2 | 5/1982 |
| DE | 295 12 585 U1 | 1/1996 |
| DE | 195 04 013 C1 | 7/1996 |
| DE | 196 05 083 A1 | 9/1996 |
| DE | 197 25 732 C2 | 1/1999 |
| DE | 197 55 530 A1 | 6/1999 |
| DE | 198 07 938 A1 | 8/1999 |
| EP | 0 128 472 A2 | 12/1984 |
| EP | 0 948 088 A2 | 10/1999 |
| EP | 0 961 378 A2 | 12/1999 |
| EP | 0 966 068 A1 | 12/1999 |
| EP | 0 971 450 A1 | 1/2000 |
| GB | 2 020 917 A | 11/1979 |

* cited by examiner

*Primary Examiner*—Renee Luebke
*Assistant Examiner*—Felix O. Figueroa
(74) *Attorney, Agent, or Firm*—Cook, Alex, McFarron, Manzo Cummings & Mehler, Ltd.

(57) ABSTRACT

An electrical connector for connecting electrical wires to an electrical apparatus (1) consists of a receiving socket (10), a contact carrier (14) arranged in the receiving socket, insulation piercing contacts (18) which are held in the contact carrier (14), and arresting means (28, 30; 32, 34) by means of which the contact carrier (14) is held in the receiving socket (10).

6 Claims, 5 Drawing Sheets

ELECTRICAL CONNECTOR FOR CONNECTING ELECTRICAL WIRES TO AN ELECTRICAL APPARATUS

BACKGROUND OF THE INVENTION

The invention relates to an electrical connector for connecting electrical wires to an electrical apparatus, insulation piercing contacts being provided which are held in a contact carrier.

An electrical connector of this type is provided for a firm connection of an electrical apparatus with one or more electrical wires, this connection being, however, disconnectable again by the use of insulation piercing contacts.

From Utility Model DE 295 12 585 is known a wire connecting element in insulation piercing contact technique for connecting electrical wires, in which the wire connecting element is provided with a threaded socket and for fastening is placed in a hole of a housing and fixed with a counter nut.

Further, from DE 197 55 530 a means for relieving strain of electrical and/or optical cables is known, in which the insulation piercing contacts are firmly connected with a housing in a corresponding structure in which is screwed a cable guiding piece provided for insulation piercing contacts and a wire guiding piece with a sleeve nut.

It is a disadvantage in these known designs of such electrical connectors that these are inserted in a housing into holes which are provided to this end and that they have to be fastened with a sleeve nut. Further, the electrical wires might be twisted upon screwing an already preassembled connector, provided with electrical wires, into a housing configured with a threaded portion, so that the electrical connections would be interrupted in an uncontrolled manner. In addition, the known designs have to be screwed by hand and/or tool during assembly.

The invention is thus based on the object to develop an electrical connector of the type initially mentioned to the effect that a simple assembly is possible.

SUMMARY OF THE INVENTION

To this end according to the invention an electrical connector for connecting electrical wires to an electrical apparatus is provided, consisting of a receiving socket, a contact carrier arranged in the receiving socket, insulation piercing contacts which are held in the contact carrier, and arresting means by means of which the contact carrier is held in the receiving socket. This design allows to pre-equip the contact carrier with the piercing contacts and then to push it into the receiving socket where it latches in place simply automatically by means of the arresting means. The contact carrier can be placed in the receiving socket in an automated manner or by hand.

The arresting means may be configured as knob-shaped cams in the receiving socket which engage into an annular groove in the contact carrier. These arresting means can be produced in a simple manner from plastic pieces.

As an alternative, the arresting means may consist of a recess in the contact carrier and a fastening pin which can be inserted into the recess. The fastening pin may be provided on a plate-shaped fastening element which can be inserted into a slot between two parallel and spaced walls of a housing of the electrical apparatus, the fastening pin engaging into the recess in the contact carrier and the fastening element being integrally with a cover of the electrical apparatus. In this way the contact carrier is automatically fastened in the receiving socket when the housing of the electrical apparatus is closed.

Preferably, the insulation piercing contacts are held in receiving slots in the contact carrier by means of detent tabs. This makes it possible to simply push the insulation piercing contacts into the contact carrier, with the result that they automatically latch in place there.

According to the preferred embodiment it is provided that the insulation piercing contacts are provided with plug connectors on their equipment side, so that cable lugs can be attached or the connecting terminals can be plugged into holes or contact springs of a printed circuit board without the need of expensive connection work such as soldering etc. In this embodiment assembling expenditure for the overall electrical connection is minimized. The insulation piercing contacts are pushed into the contact carrier in which they automatically latch in place. The contact carrier equipped with the insulation piercing contacts is pushed into the receiving socket in which it automatically latches in place. Upon being pushed in the contact carrier, the connecting terminals of the insulation piercing contacts are automatically pushed into the contact elements, associated with them, in the electrical apparatus, for instance into the contact springs. Thus, no soldering work or expensive packaging work is required; the electrical connection may even be done on the spot without special tools.

The invention also relates to a contact carrier with insulation piercing contacts which are held in the contact carrier, and arresting means with which the contact carrier can be held in a receiving socket, the insulation piercing contacts being provided with a connecting terminal by means of which they can be plugged in a cable lug or a contact spring. The invention further relates to an electrical apparatus comprising an electrical connector as described above.

The invention is now described by means of two preferred embodiments illustrated in the attached drawings in which:

DETAILED DESCRIPTION

Figure 1:
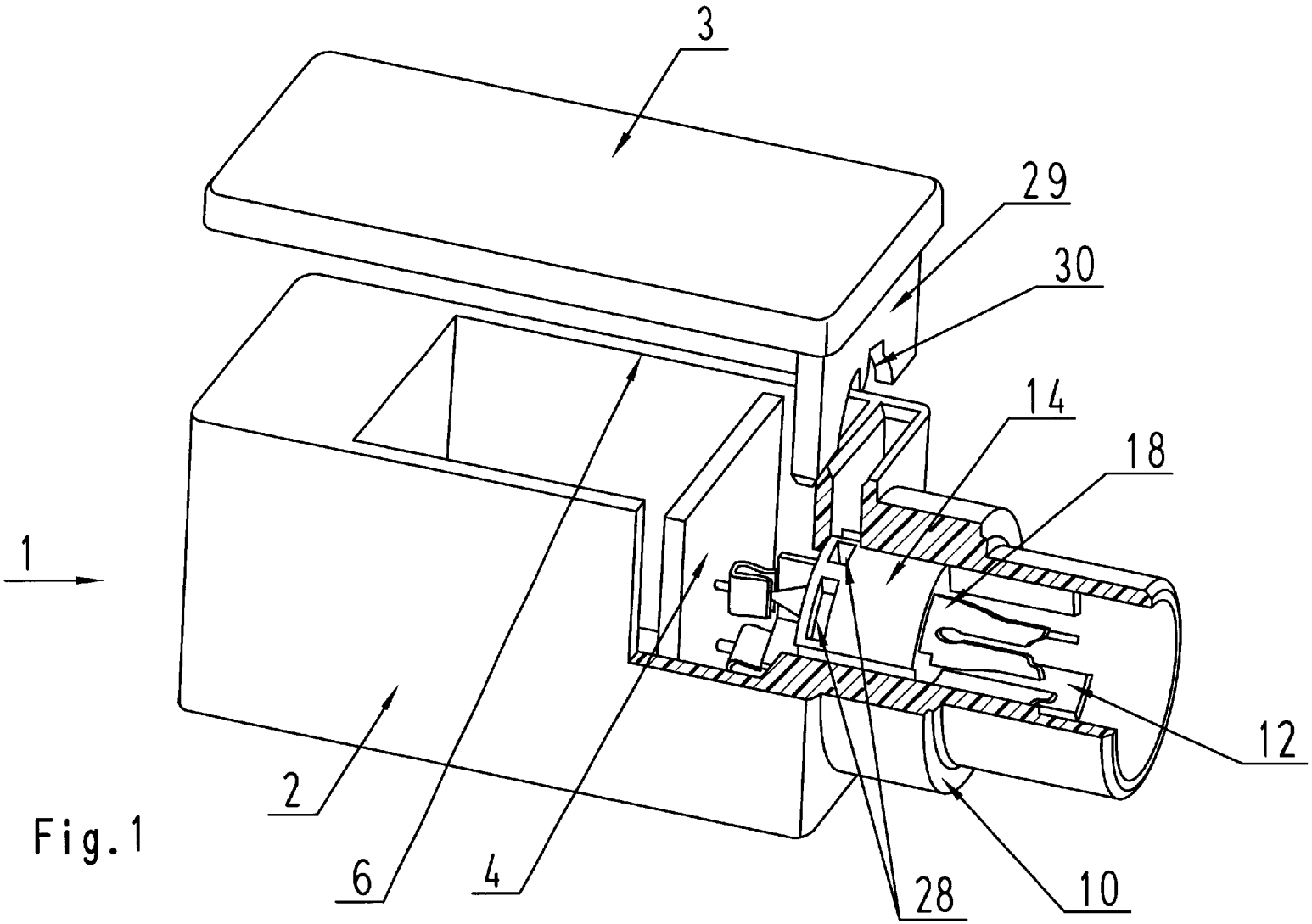
FIG. 1 shows a perspective, partially cut view of an electrical apparatus with an electrical connector according to a first embodiment.
Figure 2:
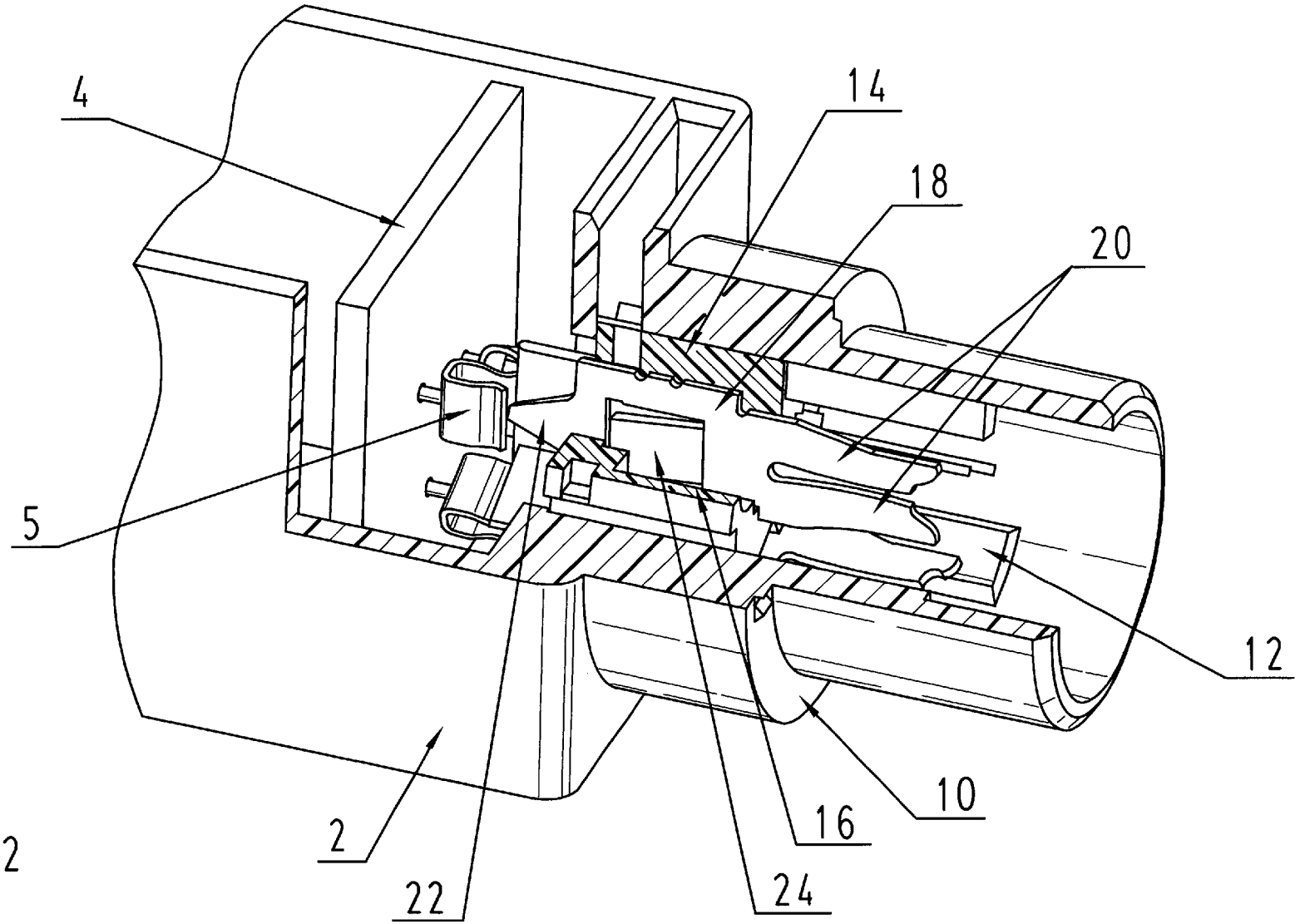
FIG. 2 shows in an enlarged view the electrical connector of the apparatus shown in FIG. 1.
Figure 3:
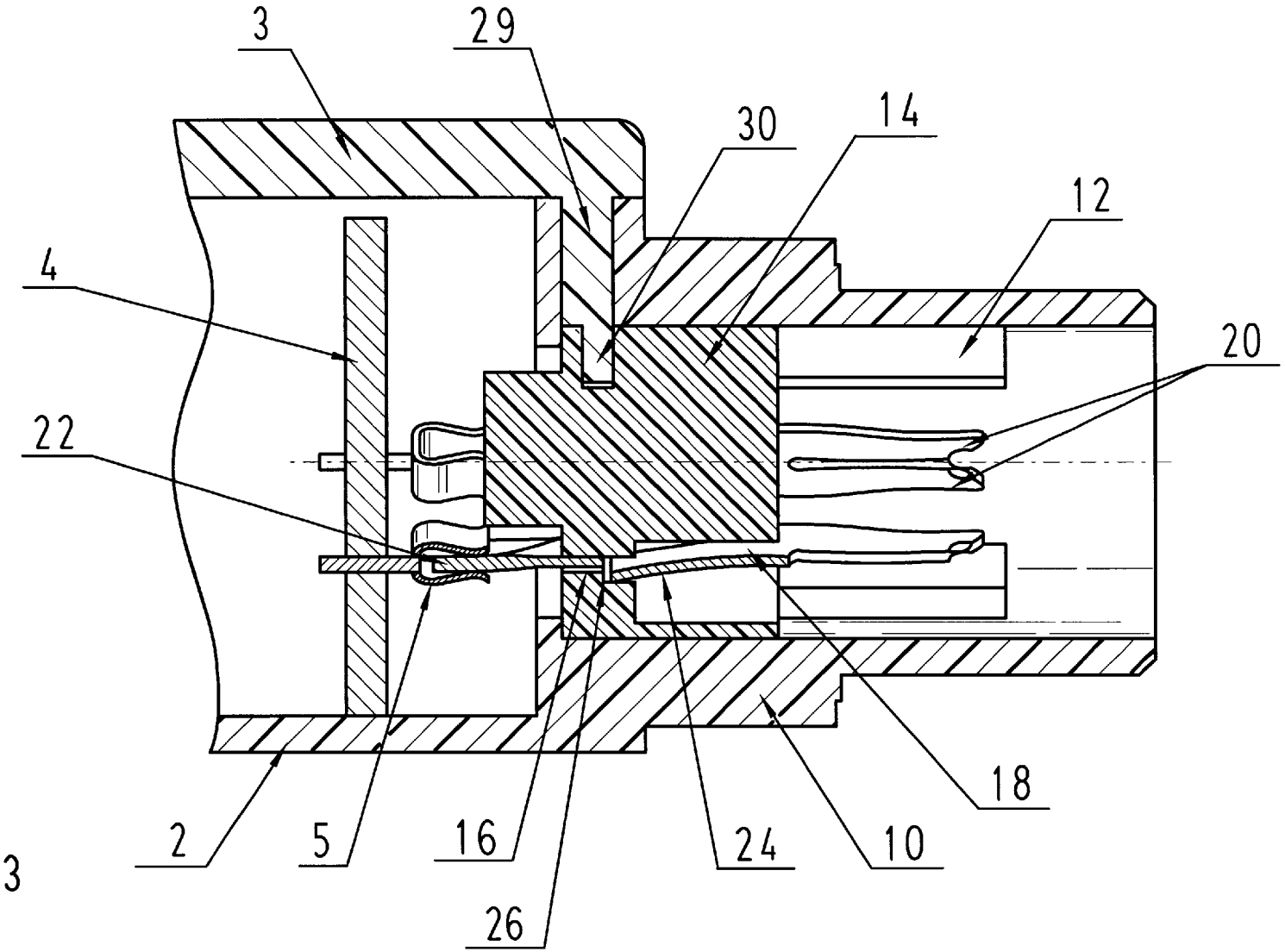
FIG. 3 shows a cross-section through the electrical connector of FIG. 2.

In FIGS. 1 to 3 there is shown an electrical apparatus 1 which has a housing 2 and a cover 3. In a cavity 6 defined in the interior of the housing a printed circuit board 4 is arranged which serves as a carrier for electronic components (not shown). A plurality of contacts 5 is plugged in holes of the printed circuit board 4, which contacts each have elastic double legs.

Arranged on the housing 2 is a cylindrical receiving socket 10 which is provided on its inner side with guiding ribs 12. The side wall of the housing 2 has the receiving socket attached to it and is configured so as to be double-walled.

In the interior of the receiving socket 10 a contact carrier 14 is arranged which is provided with slot-shaped recesses 16. In each recess 16 an insulation piercing contact 18 is arranged which is provided on one side with two piercing contacts 20 lying opposite each other and on the other with a peg-shaped connection terminal 22. The center of each insulation piercing contacts has a detent tab 24 which can cooperate with a shoulder 26 in the contact carrier 14.

The contact carrier is provided with three recesses 28 of which only two can be seen in FIG. 1. With respect to the upper recess, the third recess lies so as to be mirror-inverted to the front recess arranged at the bottom to the side.

Lid 3 of apparatus 1 is provided with a fastening element 29 on which a locking stud 30 is arranged, the latter being able to engage into one of the recesses 28.

The insulation piercing contacts consist of metal and the contact carrier consists of an insulating plastic.

Assembling the electrical connection which is comprised of the contact carrier with the insulation piercing contacts and the receiving socket is done in the following way: First the contact carrier 14 is equipped with the insulation piercing contacts 18 by pushing these into the recesses 16 until the detent tab 24 latches behind the shoulder 26 of the contact carrier. The insulation piercing contacts 18 are then firmly received in the contact carrier. Then, the contact carrier equipped in this way is pushed from outside into the receiving socket 10 in such a way that the connecting terminals 22 of the insulation piercing contacts 18 protrude into the interior of the electrical apparatus. The correct orientation of the contact carrier is ensured by the guiding rib 12 which cooperates with a suitable groove in the contact carrier. Upon pushing in the contact carrier, the connecting terminals 22 of the insulation piercing contacts 18 are pushed in between the double legs of the contacts 5, so that making electrical contact occurs automatically there. Finally, the cover 3 is placed on the housing 2, the fastening element 29 of cover 3 being able to penetrate into the space between the two side walls of the housing and the locking pin 30 engages into the recess 28 in the contact carrier. Recess 28 and locking stud 30 then act as arresting means by means of which the contact carrier is firmly held in the receiving socket.

Electrical wires can be connected with low expenditure to the apparatus 1 provided in this way with the electrical connector, and are pressed—in a manner as known per se by means of a pressing piece—into the insulation piercing contacts such that the piercing contacts 20 cut through the insulation of the wires and make contact with the wire core.

Figure 4:
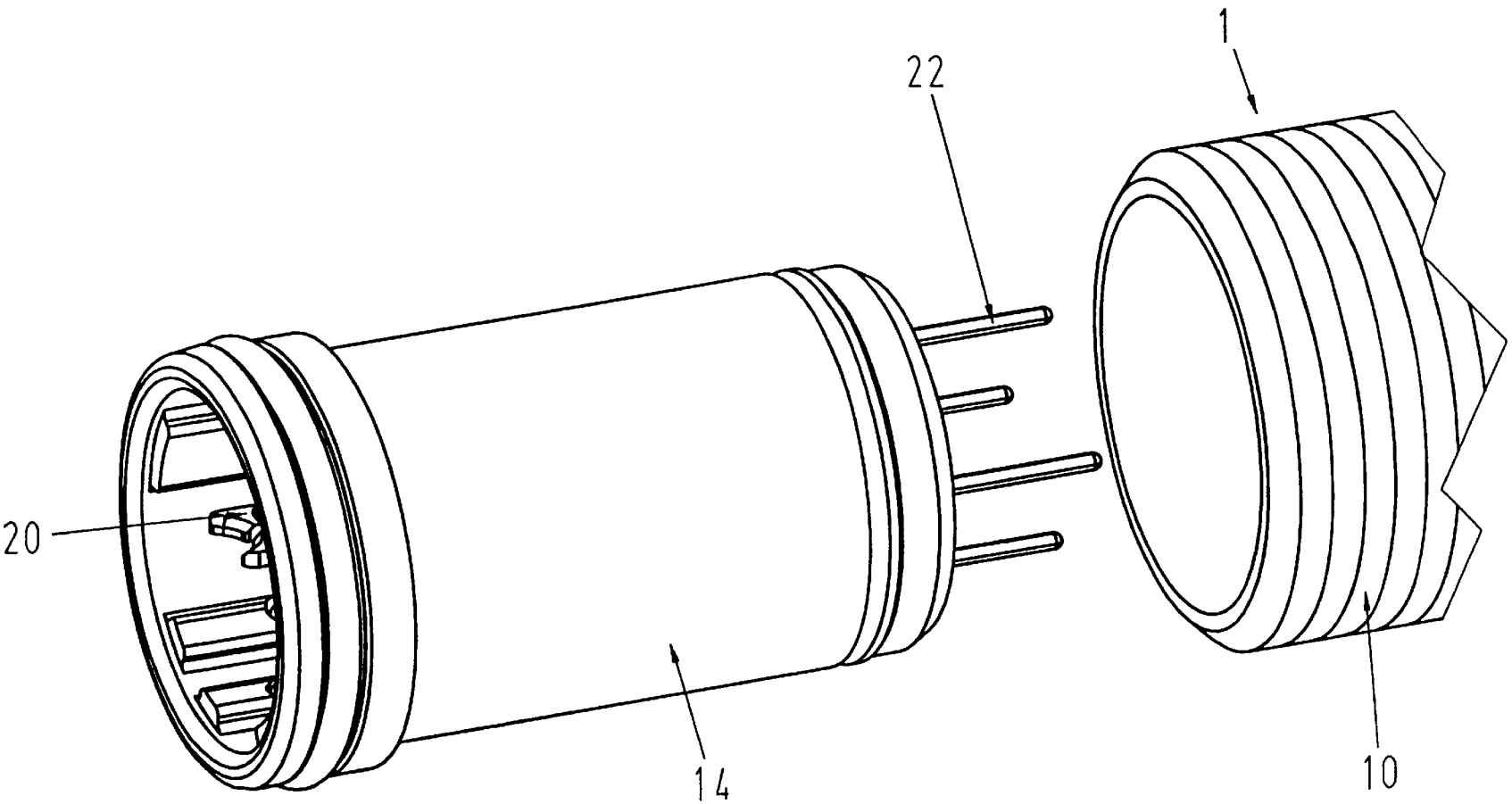
FIG. 4 shows a perspective view of an electrical apparatus with an electrical connector according to a second embodiment.
Figure 5:
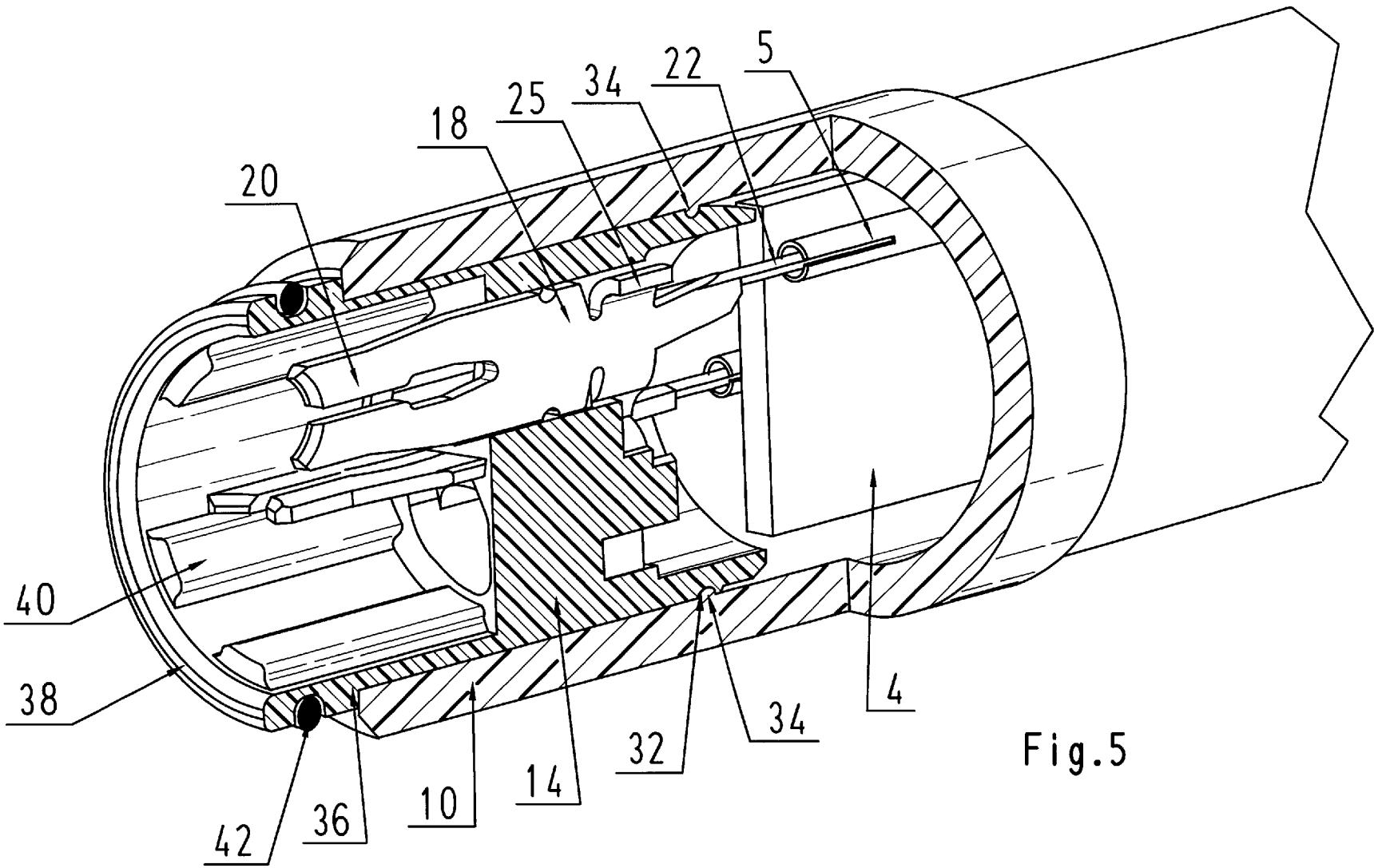
FIG. 5 shows a perspective, partially cut view of the electrical connector of FIG. 4.

A second embodiment is shown in FIGS. 4 and 5, the same reference numerals being used for the components already known from the first embodiment. In this respect it is referred to the above explanations.

Here, too, the electrical apparatus is provided with a cylindrical receiving socket 10 which has the contact carrier 14 pushed into it. Unlike the first embodiment, the insulation piercing contacts 18 are not provided with detent tabs here, but with fastening tabs 25 by means of which they are attached to the contact carrier 14.

In the second embodiment the contact carrier 14 is provided with an skirt 38 which surrounds the piercing contacts 20 of the insulation piercing contacts. Guiding ribs 40 are configured on the inside of skirt 38, which serve as a means for preventing rotation of a pressing piece which can be pressed into the skirt 38 and presses the wires to be connected into the free space between the piercing contacts 20 lying opposite each other. A sealing ring 42 is arranged on the outside of skirt 38.

Unlike the first embodiment, contacts 5 have no double legs in the second embodiment, but are configured as elastic socket contacts.

In the second embodiment the arresting means for fastening the contact carrier 14 in the receiving socket 10 consist of an annular groove 32 on the outer circumference of contact carrier 14 and of knob-shaped cams 34 on the inner wall of the receiving socket 10. When the contact carrier 14, equipped with the insulation piercing contacts 18, is pushed into the receiving socket 10, the cams 34 latch in place in the groove 32, with a shoulder 36 on the contact carrier 14 resting against the end face of receiving socket 10. On pushing the contact carrier into the receiving socket, the peg-shaped connecting terminals 22 of the insulation piercing contacts 18 are again pushed into the contacts 5.

What is claimed is:

1. An electrical connector for connecting electrical wires to an electrical apparatus (1), consisting of a housing (2) defining a cavity (6) in which a printed circuit board (4) is inserted, a receiving socket (10), a contact carrier (14) arranged in the receiving socket, insulation piercing contacts (18) which are held in the contact carrier (14) and are in electrical communication with the printed circuit board (4), and arresting means (28,30,32,34) by which the contact carrier (14) is held in the receiving socket (10), characterized in that the arresting means consist of at least one recess (28) in the contact carrier (14) and of a fastening pin (30) which is insertable into the recess, characterized in that the fastening pin is provided on a plate-shaped fastening element (29), the housing (2) being doubled walled between the receiving socket (10) and the cavity (6) to define a slot between two parallel and spaced walls, each wall having two opposite surfaces, and that the fastening element is insertable into the slot between the two parallel and spaced walls in the housing (2), the fastening pin (30) engaging into the recess (28) in the contact carrier (14).

2. The electrical connector according to claim 1 characterized in that connecting terminals on an equipment side of the insulation piercing contacts are provided with plug connectors (22) for cable lugs.

3. The electrical connector according to claim 1 characterized in that connecting terminals on an equipment side of the insulating piercing contacts (18) are provided with peg-shaped connecting terminals (22) which can be inserted into holes or contact springs of the printed circuit board (4).

4. The electrical connector according to claim 1, characterized in that by polarization means (12) the contact carrier (14) is held in the receiving socket (10) so as to be secured against rotation.

5. The electrical connector according to claim 1 characterized in that the insulation piercing contacts (18) are held in recesses (16) in the contact carrier by detent tabs (24).

6. The electrical connector according to claim 5, characterized in that the insulation piercing contacts (18) are insertable from a wire connection side of the receiving socket, the detent tabs (24) latching in the contact carrier behind shoulders (26) in recesses (16).

* * * * *